US007865360B2

(12) United States Patent
Fourquin et al.

(10) Patent No.: US 7,865,360 B2
(45) Date of Patent: Jan. 4, 2011

(54) AUDIO DEVICE

(75) Inventors: Xavier Fourquin, Sevres (FR); Pierre Bonnard, Suresnes (FR)

(73) Assignee: IPG Electronics 504 Limited, St. Peter Port (GG)

( * ) Notice: Subject to any disclaimer, the term of this patent is extended or adjusted under 35 U.S.C. 154(b) by 1201 days.

(21) Appl. No.: 10/802,835

(22) Filed: Mar. 18, 2004

(65) Prior Publication Data

US 2004/0186707 A1 Sep. 23, 2004

(30) Foreign Application Priority Data

Mar. 21, 2003 (FR) ..... 03 03468

(51) Int. Cl.
*G10L 21/00* (2006.01)

(52) U.S. Cl. ..... 704/201; 704/278; 704/205; 704/207; 704/272

(58) Field of Classification Search ..... 704/201, 704/278, 205, 207, 272
See application file for complete search history.

(56) References Cited

U.S. PATENT DOCUMENTS 5,194,682 A * 3/1993 Okamura et al. ..... 434/307 A
5,641,927 A * 6/1997 Pawate et al. ..... 84/609
5,712,437 A * 1/1998 Kageyama ..... 84/610
5,857,171 A * 1/1999 Kageyama et al. ..... 704/268
5,915,237 A * 6/1999 Boss et al. ..... 704/270.1
7,099,704 B2 * 8/2006 Taniguchi et al. ..... 455/567

FOREIGN PATENT DOCUMENTS

| | | | |
|---|---|---|---|
| EP | 1 014 674 | A1 | 6/2000 |
| EP | 1 363 272 | A1 | 11/2003 |
| JP | 09-179572 | A | 7/1997 |
| JP | 11-289361 | A | 10/1999 |
| JP | 2001-197168 | A | 7/2001 |

* cited by examiner

*Primary Examiner*—Qi Han
(74) *Attorney, Agent, or Firm*—Volpe and Koenig, P.C.

(57) ABSTRACT

An audio device for modifying the voice transmitted during a telephone call particularly suitable for a mobile telephone system receives from the user of the audio device an analog speech signal. A converter converts the analog speech signal into a digital speech signal comprising at least one fundamental frequency. A set of coded data represents a musical score comprising a set of notes, each note being defined by a fundamental frequency, a duration, and an instrument that plays the note. A digital music signal is extracted from the set of coded data, and a first portion of the digital speech signal is mixed with a first portion of the digital music signal to produce a combined digital signal.

21 Claims, 1 Drawing Sheet

3 - synthesizer
4 - mixer means
5 - summing means
6 - vocoder
8 - A/D
9 - D/A
10 - unit for storing
11 - microphone
12 - loudspeaker
13 - CODEC

AUDIO DEVICE

CROSS-REFERENCE TO RELATED APPLICATIONS

This application is based on French Patent Application No. 03 03 468 filed Mar. 21, 2003, the disclosure of which is hereby incorporated by reference thereto in its entirety, and the priority of which is hereby claimed under 35 U.S.C. §119.

BACKGROUND OF THE INVENTION

1. Field of the Invention

The present invention relates to an audio device for modifying the voice of the user of the audio device and to a telecommunication terminal capable of modifying the voice transmitted during a telephone call.

2. Description of the Prior Art

Although the transmission of speech remains the essential element of mobile telephony, it nevertheless remains a fact that manufacturers seek to differentiate their products by offering the consumer new attractive and amusing services. Games, services linked to voice recognition, and the multiplicity of ringtones are examples of this.

These new services often involve an additional cost of the telephone linked to the addition of software or hardware elements.

The present invention aims to provide an audio device offering a service of modifying the voice transmitted by the user of the terminal, in particular during a telephone call, this service being of an attractive and amusing kind and simple and economical to implement.

SUMMARY OF THE INVENTION

To this end the present invention proposes an audio device comprising:

- means for input by the user of the audio device of an analog speech signal,
- a converter for converting the analog speech signal into a digital speech signal comprising at least one fundamental frequency,
- means for storing a set of coded data representing a musical score comprising a set of notes, each note being defined by a fundamental frequency, a duration, and an instrument that plays the note,
- means for extracting a digital music signal from the set of coded data, and
- means for mixing a first portion of the digital speech signal and a first portion of the digital music signal to produce a combined digital signal.

Thanks to the invention, the voice can track the musical score.

The audio device advantageously further comprises a digital signal processor comprising the means for mixing the first portions of the digital speech signal and the digital music signal.

The means for mixing the first portions of the digital speech signal and the digital music signal advantageously comprise means for replacing the fundamental frequency of the speech signal by the fundamental frequency associated with a note of the music signal.

The fundamental frequency of the speech signal is advantageously replaced by the fundamental frequency associated with the note of the music signal during a period substantially equal to the duration of the note.

The audio device advantageously further comprises means for adding to the combined digital signal a second portion of the digital speech signal.

The audio device advantageously further comprises means for adding to the combined digital signal a second portion of the digital music signal.

The means for mixing the first portions of the digital speech signal and the digital music signal advantageously comprise means for replacing at least one harmonic frequency of the fundamental frequency of the speech signal with a harmonic frequency of the fundamental frequency associated with a note of the musical signal.

The audio device advantageously further comprises discriminator means for discriminating a consonant from a vowel in the digital speech signal and adapted to activate the means for mixing the first portions of the digital speech signal and the digital music signal during the detection of the vowel.

Thus the mixing of the speech signals and the music signals will take place after a consonant, and thus on a vowel. This detection can be effected using sliding window envelope detector means and spectral analysis.

The audio device advantageously further comprises a voice activity detector controlling the means for mixing said first portions of the digital speech signal and the digital music signal.

Thus a decision to modify the fundamental frequency of the voice may be taken only after reducing the amplitude of said voice signal.

The audio device advantageously further comprises a vocoder for coding the combined digital signal.

The present invention also proposes a telecommunication terminal having any of the foregoing features.

This service is simply and economically implemented on a telecommunication terminal by utilizing the digital signal processor (DSP) of the telephone.

Moreover, the speech and music digital signals may be mixed in real time so that the voice is modified and then transmitted directly during a telephone call.

The audio device advantageously further comprises means for transmitting said combined digital signal to another terminal in real time.

Other features and advantages of the present invention will become apparent in the course of the following description of one embodiment of the invention, given by way of illustrative and nonlimiting example.

DETAILED DESCRIPTION OF THE PREFERRED EMBODIMENT

Figure 1:
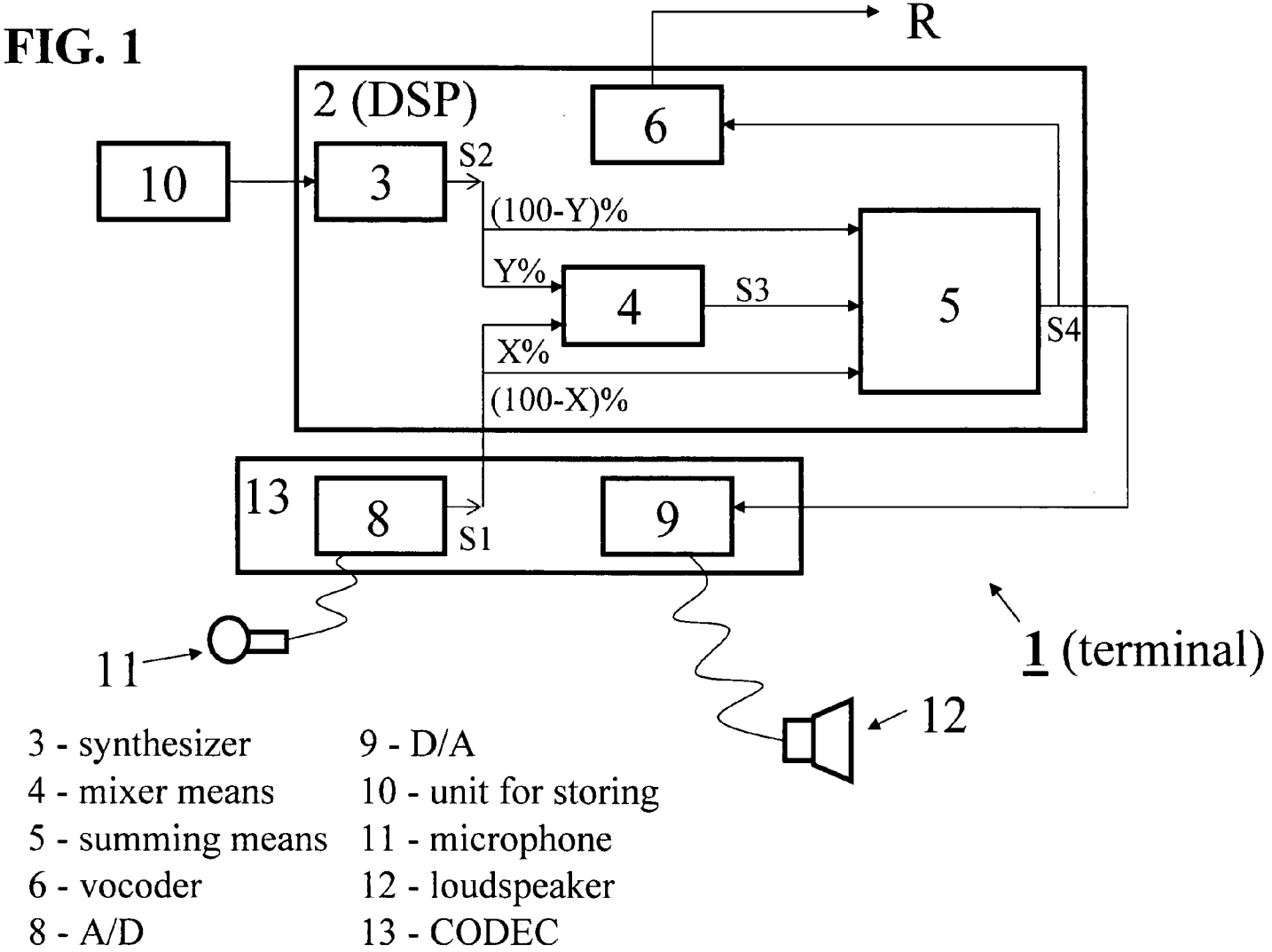
FIG. 1 is a block schematic of a telecommunication terminal of the invention.

FIG. 1 shows a telecommunication terminal 1 of the invention such as a mobile telephone.

The terminal 1 comprises:

- a digital signal processor (DSP) 2,
- a microphone 11,
- a loudspeaker 12,
- an analog-to-digital converter 8,
- a digital-to-analog converter 9, and
- a unit 10 for storing musical scores defined in a predetermined coding format.

The musical scores can have any of the following music coding formats: MIDI, Yamaha® SMAF, EMR R5 polyphonic, IrDA iMelody from IrMC (Infrared Mobile Communications), or any other music vector description format.

Each note of the musical score is characterized by its pitch, i.e. its fundamental frequency, and its timbre, i.e. the harmonics of the fundamental frequency.

The coded score comprises a set of (note, duration) pairs. The notes are interpreted in duration and in frequency, and to each note there corresponds a start date, an end date, and a plurality of frequencies (fundamental frequency and harmonic frequencies).

The converters 8 and 9 are part of the same coder/decoder (CODEC) 13 for example.

The processor 2 comprises:

a synthesizer 3, signal mixer means 4, signal summing means 5, and a vocoder 6.

The vocoder 6 is an adaptive multirate (AMR) vocoder, for example, for executing type 3 GPP TS 26.071 AM source coding.

The sound of the voice is picked up by the microphone 11. The sound pressure level is converted into an analog electrical signal in a frequency band from 300 Hz to 3400 Hz. The analog signal is divided into contiguous intervals of 20 ms duration. Each interval is digitized by the analog-to-digital converter 8.

This yields a digital speech signal S1 in the form of 20 ms frames.

Similarly, the synthesizer 3 extracts a digital music signal S2 in the form of 20 ms frames corresponding to a score stored in the storage unit 10.

The signal mixer means 4 process a proportion X% of the signal S1 and a proportion Y% of the signal S2.

The mixer means 4 therefore replace the fundamental frequency and the harmonics of the voice signal by the fundamental frequency and the harmonics of each of the notes of the music signal during the note. This substitution is effected in real time with the arrival of the sampled voice so that the voice tracks the frequencies associated with the notes of the score.

A digital filter divides the voice into noise (consonants) and successive sinusoidal signals (vowels), detected as such from their waveforms; at the output of this filter, a proportion Y% of a musical sinusoidal signal deduced from the signal S2 is substituted for a proportion X% of the speech sinusoidal signal.

A summed digital signal S3 is therefore obtained at the output of the mixer means 4.

To preserve the intelligibility of the voice, a proportion (100-X)% of the original digital voice signal S1 is retained and added to the signal S3 by the signal adding means 5.

Similarly, a proportion (100-Y)% of the original digital music signal S2 may be added to the signal S3 by the summing means 5.

The mixer means 4 and summing means 5 are software means integrated into the processor 2.

The mixed and summed signal S4 at the output of the summing means 5 is then coded by the vocoder 6 and then transmitted to other party. The signal S1 modified to track the score is therefore transmitted in real time.

The coded signal may also be stored in an AMR IETF format file which may then be sent to another terminal, for example a mobile terminal or a personal computer.

The signal S4 may also be fed to the digital-to-analog converter 10 and then to the loudspeaker 9.

Other functions that are not shown may be added to the processor.

It may be beneficial not to replace the fundamental frequency and the harmonics of the voice signal by the fundamental frequency and the harmonics of a note of the musical signal when the voice is on a consonant corresponding to a "glottal" sound. In this case the terminal may comprise sliding window envelope detector means to detect a consonant in the digital speech signal. The mixer means are then activated only at the end of the consonant.

The detector means use a fast Fourier transform (FFT) spectrum analyzer function that behaves like a bank of filters and either detects the presence of a power peak in the frequencies constituting the spectrum or detects the absence of a power peak, and thus, if a signal is nevertheless present, the presence of noise corresponding to a consonant.

Moreover, the vocoder 6 of the terminal includes a voice activity detector (VAD) for interrupting radio transmission in the absence of a voice signal. The terminal of the invention may advantageously use this kind of detector to command the mixer means. Accordingly, if the amplitude of the voice signal tends towards zero, the VAD may force the mixer means to move on to the next note of the score. The VAD operates on an on/off basis. Accordingly, during a sufficiently long period of silence in the voice signal, a command may be sent to the mixer 4 so that the score may continue to be reproduced by feeding only a portion of the digital music signal ((100-Y)% of the signal S2 in FIG. 1) to the sung digital signal, or a period of silence may be introduced into the combined digital signal, which resumes tracking the score when vocal activity resumes.

Of course, the invention is not limited to the embodiment that has just been described.

In particular, the AMR vocoder described may be replaced by any type of vocoder using source coding, such as a vocoder using RPE-LTP coding conforming to the GSM 06.10 or ETS 300 726 GSM EFR (enhanced full rate) standard.

There is claimed:

1. An audio device comprising:

a receiving unit configured to receive an analog speech signal representing a spoken message;

a converter configured to convert the analog speech signal into a digital speech signal having at least one speech signal fundamental frequency;

a storage unit configured to store a set of coded data representing a musical score comprising a plurality of notes, each of the plurality of notes being defined by a note fundamental frequency, a duration, and an instrument that plays the note;

an extracting unit configured to extract a digital music signal from the set of coded data; and a mixer configured to replace the at least one speech signal fundamental frequency of the digital speech signal with the note fundamental frequency for each of the plurality of notes of the musical score to produce a combined digital signal.

2. The audio device claimed in claim 1, wherein a digital signal processor comprises the mixer.

3. The audio device claimed in claim 1 wherein the at least one speech signal fundamental frequency of the digital speech signal is replaced with the note fundamental frequency for each note of the plurality of notes of the musical score during a period substantially equal to the duration of each respective one of the plurality of notes of the musical score.

4. The audio device claimed in claim 1 further comprising a signal summing unit configured to add to the combined digital signal a portion of the digital speech signal.

5. The audio device claimed in claim 1 further comprising a signal summing unit configured to add to the combined digital signal a portion of the digital music signal.

6. The audio device claimed in claim 1 wherein the mixer is further configured to replace at least one harmonic frequency of the fundamental frequency of the digital speech signal with a harmonic frequency of the note fundamental frequency for each of the plurality of notes of the musical score.

7. The audio device claimed in claim 1 further comprising a discriminator configured to discriminate a consonant from a vowel in the digital speech signal and to activate the mixer during the detection of the vowel.

8. The audio device claimed in claim 1 further comprising a voice activity detector configured to control the mixer.

9. The audio device claimed in claim 1 further comprising a vocoder configured to code the combined digital signal.

10. A telecommunication terminal comprising:

a receiving unit configured to receive an analog speech signal;

a converter configured to convert the analog speech signal into a digital speech signal comprising at least one speech fundamental frequency;

a storage unit configured to store a set of coded data representing a musical score comprising a plurality of notes, each of the plurality of notes being defined by a note fundamental frequency, a duration, and an instrument that plays the note;

an extracting unit configured to extract a digital music signal from the set of coded data; and a mixer configured to replace the at least one speech signal fundamental frequency of the digital speech signal with the note fundamental frequency for each of the plurality of notes of the musical score to produce a combined digital signal.

11. The telecommunication terminal claimed in claim 10 further comprising a transmitter configured to transmit the combined digital signal to another terminal in real time.

12. The telecommunication terminal claimed in claim 10, wherein a digital signal processor comprises the mixer.

13. The telecommunication terminal claimed in claim 10 wherein the at least one speech signal fundamental frequency of the digital speech signal is replaced with the note fundamental frequency for each note of the plurality of notes of the musical score during a period substantially equal to the duration of each respective one of the plurality of notes of the musical score.

14. The audio device claimed in claim 10 further comprising a signal summing unit configured to add to the combined digital signal a portion of the digital speech signal.

15. The audio device claimed in claim 10 further comprising a signal summing unit configured to add to the combined digital signal a portion of the digital music signal.

16. The telecommunication terminal claimed in claim 10 wherein the mixer is further configured to replace at least one harmonic frequency of the fundamental frequency of the digital speech signal with a harmonic frequency of the note fundamental frequency for each of the plurality of notes of the musical score.

17. The telecommunication terminal claimed in claim 10 further comprising a discriminator configured to discriminate a consonant from a vowel in the digital speech signal and to activate the mixer during the detection of the vowel.

18. The telecommunication terminal claimed in claim 10 further comprising a voice activity detector configured to control the mixer.

19. The telecommunication terminal claimed in claim 10 further comprising a vocoder configured to code the combined digital signal.

20. An apparatus comprising:

means for receiving an analog speech signal representing a spoken message;

means for converting the analog speech signal into a digital speech signal having at least one speech signal fundamental frequency;

means for storing a set of coded data representing a musical score comprising a plurality of notes, each of the plurality of notes being defined by a note fundamental frequency, a duration, and an instrument that plays the note;

means for extracting a digital music signal from the set of coded data; and means for replacing the at least one speech signal fundamental frequency of the digital speech signal with the note fundamental frequency for each of the plurality of notes of the musical score to produce a combined digital signal.

21. The apparatus of claim 20, wherein the apparatus is a communication terminal.

* * * * *